US012280307B2

(12) United States Patent
DeFatta

(10) Patent No.: US 12,280,307 B2
(45) Date of Patent: Apr. 22, 2025

(54) APPARATUS AND METHOD FOR PROVIDING A GAUGE FOR SQUAT EXERCISE AND OTHER EXERCISES

(71) Applicant: Blake DeFatta, Shreveport, LA (US)

(72) Inventor: Blake DeFatta, Shreveport, LA (US)

( * ) Notice: Subject to any disclaimer, the term of this patent is extended or adjusted under 35 U.S.C. 154(b) by 179 days.

(21) Appl. No.: 18/359,243

(22) Filed: Jul. 26, 2023

(65) Prior Publication Data

US 2025/0032884 A1 Jan. 30, 2025

(51) Int. Cl.

| | |
|---|---|
| ***A63B 71/06*** | (2006.01) |
| ***A63B 23/04*** | (2006.01) |
| ***A63B 24/00*** | (2006.01) |
| ***A63B 71/00*** | (2006.01) |

(52) U.S. Cl.

CPC ..... *A63B 71/0619* (2013.01); *A63B 23/0405* (2013.01); *A63B 24/0062* (2013.01); *A63B 71/0036* (2013.01); *A63B 2023/0411* (2013.01); *A63B 2071/0625* (2013.01); *A63B 2071/0694* (2013.01); *A63B 2220/20* (2013.01); *A63B 2220/805* (2013.01)

(58) Field of Classification Search

CPC ..... A63B 71/0619; A63B 23/0405; A63B 24/0062; A63B 71/0036; A63B 2023/0411; A63B 2071/0625; A63B 2071/0694; A63B 2220/20; A63B 2220/805; A63B 2225/093

See application file for complete search history.

(56) References Cited

U.S. PATENT DOCUMENTS

| | | | | |
|---|---|---|---|---|
| 5,679,105 | A * | 10/1997 | Vittone | A63B 21/072 482/148 |
| 2012/0220432 | A1* | 8/2012 | Henesey | A63B 21/078 482/105 |
| 2017/0216665 | A1* | 8/2017 | Mahr | A63B 71/0619 |
| 2017/0326401 | A1* | 11/2017 | Durket | A63B 23/0405 |
| 2018/0056108 | A1* | 3/2018 | Kelly | A63B 21/078 |
| 2023/0141420 | A1* | 5/2023 | Booker-Bell | A63B 21/4029 482/8 |

OTHER PUBLICATIONS

CA3069165 and machine translation thereof (Year: 2021).*
JP 2022018169 and machine translation thereof (Year: 2022).*
TW 1868029 and machine translation thereof (Year: 2024).*

* cited by examiner

*Primary Examiner* — Sundhara M Ganesan
(74) *Attorney, Agent, or Firm* — Vitale Vickrey Niro Solon & Gasey LLP

(57) ABSTRACT

The present inventions relate to the field of physical exercise equipment and techniques, and more specifically, a squat rack apparatus and method of performing a squat using an apparatus to gauge the optimal or desired depth of the squat without interfering with the performance of the exercise. The invention provides for a base positioned in proximity to an individual performing a squat, guideposts affixed to the base, the guideposts include a plurality of guide gauge indicators, an attachment mechanism configured to interact with guide gauge indicators wherein the guidepost attachment mechanisms are positioned in parallel relationship, and a depth indicator wherein the depth indicator operates to contact the user when the user has reached the maximum selected squat depth for the squat exercise to notify the user that the user has reached the maximum desired depth of the squat exercise.

20 Claims, 9 Drawing Sheets

APPARATUS AND METHOD FOR PROVIDING A GAUGE FOR SQUAT EXERCISE AND OTHER EXERCISES

FIELD OF THE INVENTION

The present inventions relate to the field of physical exercise equipment and techniques, and more specifically, to a squat invention/device that provides a gauge to measure the optimal depth of a user to perform a squat exercise and alert the user that the optimal depth has been obtained/achieved. Among other things, the disclosed inventions provide a squat depth apparatus and method of performing a squat utilizing a guidepost having a plurality of guide gauge indicators, depth indicator and attachment mechanisms to gauge the optimal, or desired, depth of the squat without interfering with the performance of the exercise. The depth indicator operates to alert the user that the optimal depth of the squat has been reached.

DISCUSSION OF THE PRIOR ART

The barbell squat has been considered "the King of all Exercises." The barbell squat is an exercise that helps build leg muscles, including the quadriceps, hamstrings, the gluteus muscle group and the calves. The squat also isometrically uses the erector spinae and the abdominal muscles. The squat exercise creates an anabolic environment which promotes body-wide muscle building. The Squat exercise may be performed at such intensity that the exercise triggers the release of testosterone and human growth hormones within the body, which are vital for muscle growth and will improve muscle mass in other muscle groups within the body besides the leg muscles.

A squat is a strength exercise in which the trainee lowers their hips from a standing position and then stands back up. The trainee will bend their knees to lower the buttocks to a position where the quadricep muscles of the user are positioned parallel to the ground or at a 90-degree angle with a wall. During the descent, the hip and knee joints flex while the ankle joint dorsiflexes; conversely the hip and knee joints extend and the ankle joint plantarflexes when standing up. Squats also help strengthen the hip muscles. Squats are considered a vital exercise for increasing the strength and size of the lower body muscles, as well as developing core strength. The exercise may be performed with or without a barbell. When the squat is performed using the barbell, the barbell is positioned on the upper back, near the shoulders of the user. The barbell may be loaded with weights to increase the difficulty and/or offer a greater challenge to performing the squat exercise.

The squat is one of the three lifts in the strength sport of powerlifting, together with the deadlift and the bench press. It is also considered a staple exercise in many popular recreational exercise programs, as well as, the very popular Cross Fit Games.

The squat exercise begins from a standing position. Weight is often added and is typically in the form of a loaded barbell. Dumbbells and kettlebells may also be used. When a barbell is used, it may be braced across the upper trapezius muscle, which is termed a high bar squat, or held lower across the back and rear deltoids, termed a low bar squat. The squatting movement is initiated by moving the hips back and bending the knees and hips to lower the torso and accompanying weight, then returning to the upright position.

Squats can be performed to varying depths. The competition standard is for the crease of the hip (top surface of the leg at the hip joint) to fall below the top of the knee; this is colloquially known as "parallel" depth or a ninety-degree. It is understood that for the participant in the squat exercise to truly benefit from the squat, he or she must reach a position where the upper thigh (top of the quadricep muscle) is at least parallel to the floor.

In the past, users would measure the depth of a squat through an on-looker (workout partner) or a spotter who would indicate when an individual conducting the exercise reached the desired depth of the squat. Additionally, individuals may use a bench that is placed behind the individual conducting the squat exercise such that the buttocks of the individual would touch the top of the bench at the lowermost point of the squat. It is further understood that trainers have used objects such as yoga blocks that are held under an individual's buttocks to measure the lowermost height of the squat. These methods do not always provide for much adjustability in the measurement of the squat. Additionally, it is difficult for the person performing the squat exercise to know precisely when their quad muscles have reached the "parallel to the floor position" while performing the exercise to protect the neck vertebrae and the spine. Even with the benefit of using a mirror, it is difficult to determine the exact moment that the top of the quadricep muscles become parallel to the floor, especially since the chin should be held up when performing a squat to protect the neck vertebrae and the spine.

There is a risk while performing the squat exercise that a participant will look downward to see if he or she has achieved the lowermost point of the exercise. It is important to look upward in order to keep the back straight during the squat exercise. If the back is rounded, often as a result of the participant looking downward, the back becomes extremely susceptible to injury. There is a need to prevent injury caused by the participant looking downward and injuring his or her back.

There is a need in the industry to assist individuals who are interested in measuring the optimal depth of the squat (which also equals the maximum benefit from the squat) that is adjustable for the height of the individual and also is adjustable based on the preferred height an individual desires to conduct the squat. It is also desirable to have the squat depth indicator that does not interfere with the individual's ability to properly conduct the squat exercise.

BRIEF SUMMARY OF THE INVENTIONS

Embodiments of the inventions improve upon the prior art by providing squat gauge apparatus that is adjustable in height to measure and alert the individual conducting the squat that his or her quadricep muscles have obtained a parallel position to the floor during the exercise.

Embodiments of the inventions are directed to a product that is easily moveable, as well as adjustable, and does not interfere with an individual conducting the squat exercise.

In some embodiments, the squat height measurement device can be made of a durable plastic or poly-carbonate material, having a base, two posts removably attached to the base, wherein the posts have a plurality of holes configures to accommodate a flexible cord at various predetermined height increments.

The present invention provides the user of the squat height measurement apparatus of the present invention with the benefit of a depth indicator to alert the participant of the desired height of the lower movement in the squat exercise such the participant does not need to lower his or her head during the exercise to see if the desired height of the movement has been achieved.

The present invention provides a height measurement apparatus and method of performing a squat utilizing a guidepost having a plurality of guide gauge indicators, depth indicator and attachment mechanisms to gauge the optimal, or desired, depth of the squat without interfering with the performance of the exercise. The depth indicator operates to alert the user that the optimal depth of the squat has been reached when the glutes contact the flexible cord.

Additionally, embodiments of the present invention, the base may be configured such that the posts of the squat height measurement device and the flexible cord may be stored in the base.

Some embodiments may include a handle attached to the base for the easy transport of the apparatus.

Furthermore, a benefit of the invention is that a trainer can assist multiple clients in the squat exercise without having to attend to each individual client to ensure that they have reached the "parallel to floor" position during the squat exercise.

Embodiment of the present invention may include laser sensor apparatus that alert the user of when the optimal position (parallel to the floor) has been obtained/achieved by a participant during the squat exercise.

It is important to note that biomechanically, it is much safer and more natural for an individual performing the squat to achieve "quadriceps parallel to the floor" than to attempt to stop the decent of the weighted squat prior to becoming parallel to the floor and attempt to ascend to an upright position, which can lead to strain of the lower back.

DRAWINGS

DETAILED DESCRIPTION OF THE PREFERRED EMBODIMENTS

Figure 1:
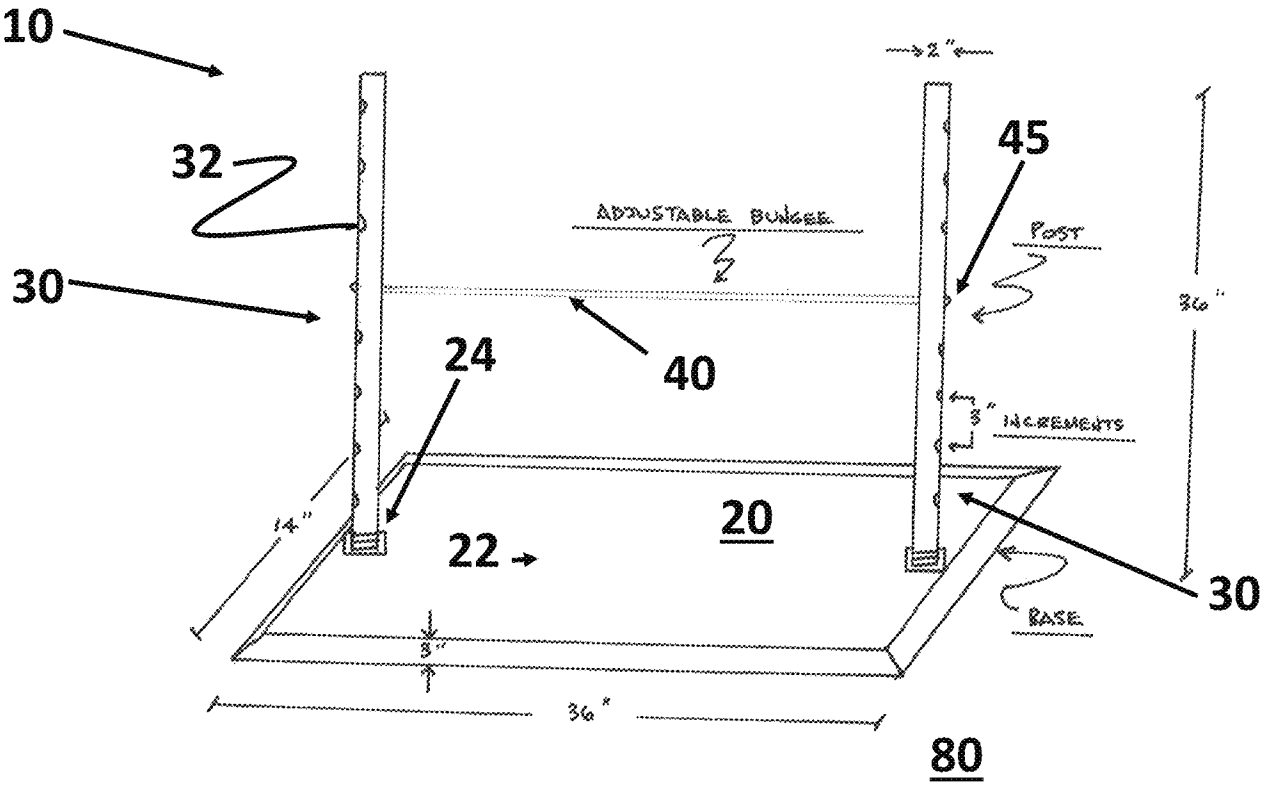
FIG. 1 is a perspective view an embodiment of the squat height measurement device.

Before any embodiments of the invention are explained in detail, it is to be understood that the inventions are not limited in their application to the details of construction and/or arrangement of components set forth in the following description or illustrated in the following drawings. The invention is capable of other embodiments, and of being practiced or carried out in various ways. Also, it should be understood that the phraseology and terminology used herein should not be regarded as limiting the scope of the inventions unless explicitly stated.

The following discussion is presented to enable a person skilled in the art to make and use embodiments of the inventions. Various modifications to the illustrated embodiments will be readily apparent to those skilled in the art. Thus, embodiments of the invention are not intended to be limited to the embodiments shown but are to be accorded the widest scope consistent with the principles and features disclosed herein. The following detailed description is to be read with reference to the figures, in which the elements in different figures have life reference numerals. The figures, which are not necessarily to scale, depict selected embodiments and are not intended to limit the scope of embodiments of the inventions. A person having ordinary skill in the art will recognize the examples provided herein have many useful alternatives and fall within the scope of embodiments of the invention.

The present invention relates to an apparatus and method of measuring the proper depth of a squat to ensure that the person participating in the exercise lowers his or her body in such a manner that the top of the participants quadricep muscles become parallel to the floor or at a 90-degree angle to the squat rack or vertical wall. It is understood that to obtain the optimal benefit from the squat exercise, he or she must lower the body (whether performing a weightless squat, a barbell squat, or a dumbbell squat) by using the leg muscles and bending at the knees and waste to reach a position where the top of the quadricep muscles are positioned parallel to the floor. If the participant wishes to optimize the effect of the squat exercise on the hamstrings, quadriceps and gluteus muscle groups, the participant must know where the "quadriceps parallel to the floor" mark is during the exercise. Without knowing that position, the participant will not realize or achieve the true benefit if the squat exercise.

The present invention relates to a gauge mechanism that is placed behind the participant during the exercise. The gauge mechanism is comprised of a base and two guideposts and an "adjustable" depth indicator. The guideposts may be affixed to the base. The guideposts include a plurality of attachment mechanisms on each guidepost that correlate to the position/depth of a squat. The depth indicator is affixed to the guideposts at the desired height of the squat such that the participant's thighs (quadriceps) become parallel to the floor at the lower-most (proper depth) movement of the squat exercise. The participant knows when the desired depth of the squat is reached when the depth indicator signals that the depth has been reached. The squat rack gauge mechanism of the present invention has the benefit of having a depth indicator that alerts the user that the;

Turning now to FIG. 1, the squat depth gauge mechanism 10 includes a base 20, guideposts 30 and depth indicator 40. The base 20 of the squat depth mechanism 10 may be made of a durable plastic material such as polycarbonate, high density polyethylene or heavy-duty acrylonitrile butadiene styrene. The base 20 could be made of other material such as metal or fiberglass. The base 20 is configured such that the top surface 22 of the base 20 measures 3 inches from the floor 80. The base 20 includes pockets 24 that are configured to accept the guideposts 30. The pockets 24 may be configured in such a manner as to secure the guideposts 30 through friction. Alternately, the pockets 24 may be configured within the base 30 to be threaded such that the guideposts 30 may be thread ably engaged with the base.

Figure 2:
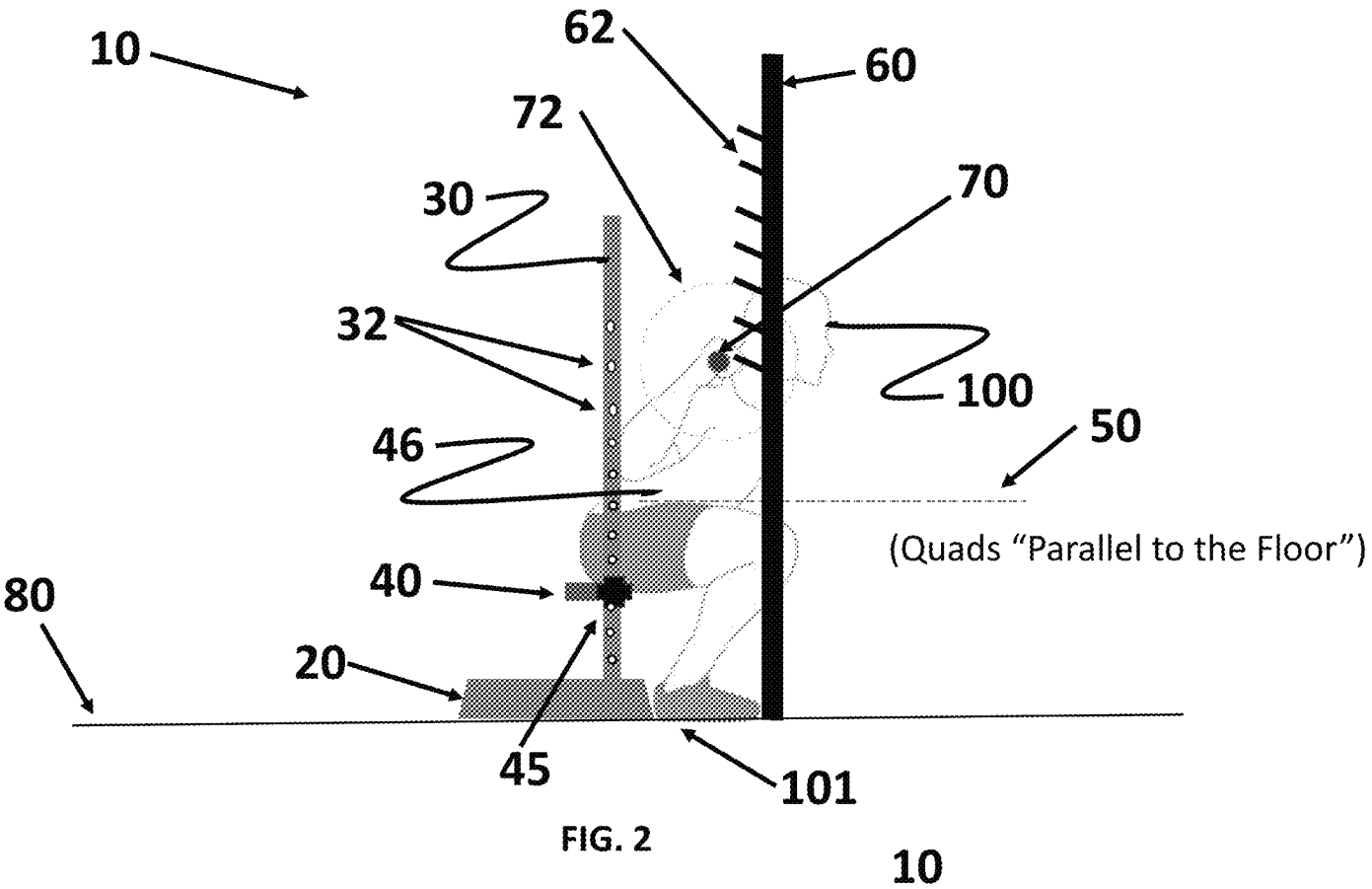
FIG. 2 is a side view of the squat height measurement device depicting an individual engaging in a squat exercise where the individual has achieved parallel to the floor quadriceps position.
Figure 3:
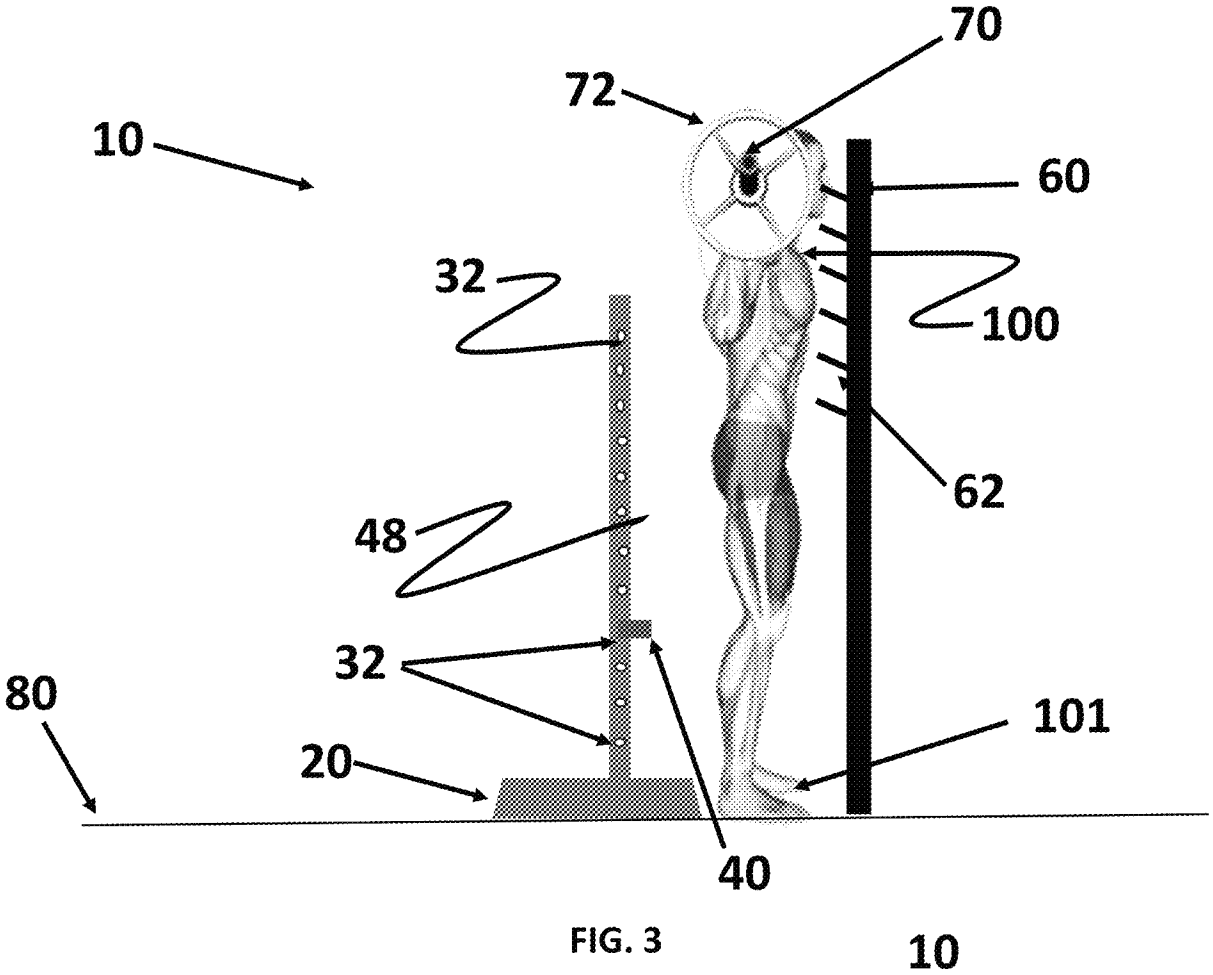
FIG. 3 is a side view of the squat height measurement device depicting an individual engaging in a squat exercise where the individual is at the extended or starting height of the exercise.
Figure 4:
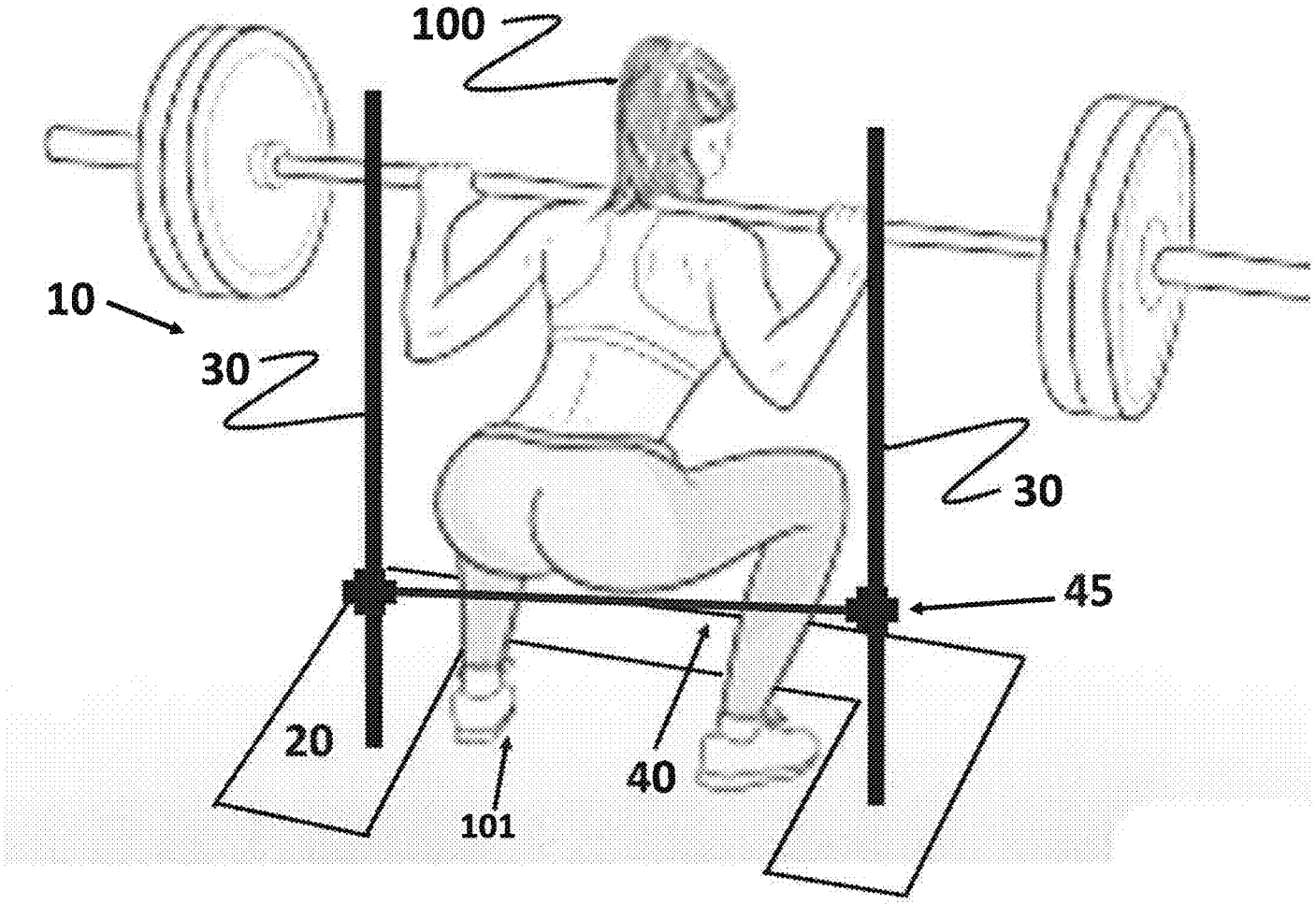
FIG. 4 is a rear perspective view of the squat height measurement device depicting an individual engaging in a squat exercise where the individual is at a "quadriceps parallel to floor" position of the exercise and is being alerted that the end of the movement has been achieved.

The base 20 may have dimensions of 14 to 20 inches by 36 inches to comfortably accommodate the feet 101 of the participant. While those are the preferred dimensions the base could have any dimensions or shape so long as it is configured to accommodate the feet of a user. The base 20 may be circular, square, U-shaped or even triangular in shape. The base 20 is configured in a manner such that it does not interfere with the feet 101 of the participant 100 during the exercise. As shown in FIGS. 2 and 3, the base 20 of the squat depth gauge mechanism 10 does not interfere with the feet 101 of the participant 100 while the participant 100 is performing the exercise. The heal of the participant does not make contact with the base 20 of the squat depth gauge mechanism 10 alternatively, the top surface 22 of the base may be configured to receive the feet of the participant (not shown in FIG. 1) on the top surface 22 of the base 20. The top surface 22 of the base 20 may have an anti-skid surface to prevent the feet of the participant from slipping when the participant is positioned on the base 20 during the squat exercise. The base 20 could also be u-shaped as shown in FIG. 4 to reduce any interference of the base with the feet 101 of the participant 100.

The present invention includes a guidepost 30 and preferably at least a pair of guideposts 30. The guidepost 30 may be made of a durable plastic material such as polycarbonate, high density polyethylene or heavy-duty acrylonitrile butadiene styrene. The guidepost 30 could also be made of other material such as metal or fiberglass. The guideposts 30 are affixed to the base 20 through the pockets 24. The guideposts 30 include a plurality of guide gauges 32. The guide gauges 32 may be holes in the guideposts 30. Alternatively, the guide gauge 32 could be a fastener or bracket.

The guidepost 32 may include an indicator mark such as a number placed on the guidepost 30 at predetermined interval. For example, the guide gages 32 may consist of marks that could be placed could be at 3-inch increments starting with #1 at the top-most hole down to the lowest guide gage 32. The opposing guidepost 30 could have the same marks to correspond with the heights of the guide gage 32 on the first guidepost 30. The numeric system on the guideposts 32 will represent progress by getting lower over the course of performing the exercise.

The guide gauges 32 of the guidepost 30 function to provide the proper measurement to position the depth indicator 40 on the guideposts 30. The guide gauges 32 are preferably positioned at 3-inch increments along the guideposts 30. This allows for the adjustment of the depth indicator 40 at and 3" positions along the guideposts 30. While the preferred increments of the guide gauges 32 may be 3 inches, it should be understood that any increment may be used. For example, the increment of the guide gauges 32 may be the increment may be 2 inches, 6 inches or up 12 inches. The guide gauges 32 of the guideposts 30 may also function to provide the proper a means to attach the depth indicator 40 on the guideposts 30.

The guide gauges 32 of the guidepost 30 may be implemented along the entire length of the guidepost 30 to maximize the number of height adjustments that can be accommodated by the apparatus. It is also important to recognize that the squat rack gauge mechanism 10 may be used to gauge the proper depth of a pushup exercise. That is why the guide gages 32 be implemented along the entire length of the guidepost 32. The depth indicator 40 could be used to contact the chest of a participant chest at a desired lowermost portion of a pushup.

The preferred embodiment depicts the guide gauges 32 as holes in the guidepost 30 to accommodate the attachment mechanism 45, which are hooks, sliding clamps with spring loaded pins or similar. It should be understood that other types of guide gauges 32 and attachment mechanisms 45 could be implemented without departing from the spirit of the invention. For example, the guide gauges 32 could comprise a visual height indicator and the attachment mechanisms 45 could comprise either a movable lock or a removeable clamp that would align with the visual guide gages 32. The important feature of the guide gauges 32 is that the guide indicators may be positioned in such a manner to gauge the depth of the squat performed by a participant. The height of the attachment mechanism 45 is determined by the height at which a participant 100 would contact the depth indicator 40 at the desired depth of the squat exercise. As such, the height of the participant 100 typically determines the desired height to place the attachment mechanism 45 on the guide gages 32.

The depth indicator 40 can be affixed to the guideposts 30 by means of an attachment mechanism 50. The attachment mechanism 45 is configured such that the depth indicator 40 may be attached to the guideposts 30 at the guide gauges 32 at various heights along the guideposts 32. The guide gauge 32 positions correspond to the desired height of the squat which will be explained in more detail with respect to FIGS. 2, 3 and 4 below.

The attachment mechanism 45 may be as simple as a hook which would be inserted into guide gauge 32 of the guideposts 30. In that embodiment the guide gauges 32 would comprise a hole in the guidepost 30 into which the attachment mechanism 45, a hook, would be inserted into the hole. The attachment mechanism 45 could also be a clamp mechanism, a pin insert, a sliding bracket or the like. The important feature of the attachment mechanism 45 is that it secures the depth indicator 40 to the guidepost at a height indicated by the guide gauge 32.1 The depth indicator 40 could consist of a flexible cord, such as a bungee cord, or a piece of flexible plastic. There are other embodiments of the depth indicator 40 and attachment mechanism 45 which are contemplated by the invention. For example, the attachment mechanism 45 could comprise a moveable clamp mounted to the guidepost 30 in such a manner that the moveable clamp can be positioned at the various guide gauges 32 along the guidepost 30. The depth indicator 40 could be attached to the moveable clamp in such a manner that the depth indicator 40 could be positioned along the guideposts 30 at the various guide gauge 32 positions along the guideposts 30. The attachment mechanism 45 may comprise an electronic depth indicator 40 which would include a laser light generated between the depth indicator 40 on each of the guideposts 30. The depth indicator could emit either a visible or an audio signal when the participant has reached the proper depth of the squat.

FIGS. 2, 3 and 4 demonstrate the squat rack gauge mechanism 10 in use. FIG. 2 depicts the squat rack gauge mechanism 10 positioned in relation to a standard squat rack 60. The participant 100 is shown in the lower squat position, typically called the 90-degree position or "quads parallel to the floor" position. As can be seen in FIG. 2, the participant 100 is in the lower most squat position where his or her thighs 46 are positioned parallel to the floor 80 or at a 90-degree angle 50 to the squat rack 60. The squat rack 60 has several posts 62 that are configured to receive the barbell 70 when the weights are positioned at the beginning and end of the squat routine. The participant 100 is shown using a barbell 70 containing weights 72 positioned on the barbell 70. While the figures show the squat height gauge mechanism 10 used in combination with a squat rack and a barbell, it should be understood that the squat rack gauge mechanism 10 could be implemented by a participant 100 that is not using a squat rack or barbell 70, or even be implemented with a participant that is using dumbbells instead of a barbell.

The squat rack gauge apparatus 30 is positioned in relation to the participant 100. Prior to beginning the exercise, the participant 100 may adjust the height of the depth indicator 40 on the guideposts 30. The depth indicator 40 is adjusted to one of the guide gauge indicators 32 that somewhat correlate to the height of the participant 100 along the quadricep muscle of the participant 100 when the participant 100 is in the 90-degree position 46 of the squat. When the participant is at the lowermost position in which the quadricep muscle 46 is parallel to the floor, the Gluteus muscle (or other part) of the participant 100 contacts the depth indicator 40 to alert the participant 100 that he or she has reached ta position in which the gluteus muscle is parallel to the floor position 46 of the lift, or at a desired maximum depth of the exercise, and should initiate the upward movement.

The squat rack gauge mechanism 10 is shown positioned behind the participant 100 and the participant 100 positions himself between the squat rack 60 and the squat rack gauge apparatus 10. The squat rack gauge apparatus 10 includes a base 20, guideposts 30, the attachment mechanism 45 and a depth indicator 40. The depth indicator 40 should be positioned on the guideposts 30 at a height corresponding to when the indicator contacts the glutes, which also corresponds to when the "quads becoming parallel to the floor" height of the participant 100 when the participant 100 is in the 90-degree position of the exercise as shown in FIGS. 2 and 4. The proper squat depth gauge apparatus is positioned behind the participant 100 to start the squat exercise.

FIG. 3 shows the participant 100 at the starting and ending position of the squat exercise. The participant 100 positioned his or her feet 101 in the proximity of the base 20. The barbell 70, having the weights 72, is positioned on the shoulders of the participant 100. It should be understood that the squat exercise could be performed with bodyweight and/or dumbbells instead of a barbell without departing from the spirit of the invention.

The quads of the participant 100 start in the fully extended position where the knee joint is substantially extended as shown in FIG. 3. The squat depth gauge apparatus 10 is positioned behind the participant 100. The depth indicator 40 is positioned on the guideposts 30 at the appropriate gauge indicator 32 for the participant 100 such that the participant's glutes will contact the depth indicator when the quads become parallel to the floor during the squat exercise.

The participant 100 removes the barbell from the rail 62 of the squat rack 60. The squat rack has plurality rails 62 to accommodate different sized participants 100. The barbell 70 is supposed to be positioned along the shoulders of the participant 100 the rails 62 of the squat rack 60 allows the barbell 70 to be positioned at the shoulder height of the participant 100. Once the participant 100 removes the barbell 70 from the squat rack 60 and steps backwards a few steps, the exercise begins. The participant 100 begins to bend his or her knees to lower the weight 72 and the barbell 70 positioned on the participant 100. The participant continues to lower the weight 72 by bending at the knees until the participant's glutes contact the depth indicator 40. Contacting the depth indicator 40 indicates to the participant 100 that he or she has reached the "quads parallel to the floor position" 46 of the exercise as shown in FIG. 2. At this time the participant begins to extend his or her legs to return to the fully extended position depicted in FIG. 3.

FIGS. 2 and 4 show the glutes of the participant 100 contacting the depth indicator 40 at the lowermost or "quads parallel to the floor" position of the exercise. The depth indicator 40 is positioned at the appropriate height for the participant 100 by placing the attachment mechanism 45 at the corresponding guide indicator 32 on the posts 30. The participant's 100 feet 101 are positioned on the base 20 of the squat rack gauge mechanism 10. As can be seen in FIGS. 2 and 4, the glutes of the participant contacts the depth indicator 40 at the lowermost position of the squat when the participant's quads 46 have become parallel to the floor. FIG. 4 shows an alternative base 20 in which the base 20 has a u-shape that surrounds the feet 101 of the participant 100. The base 20 does not interfere with the feet 101 of the participant 100 when the squat exercise if being performed with a squat rack (shown in FIGS. 2 and 3). The participant 100 can move backward from a squat rack without the base 20 interfering with the feet 101 of the participant 100.

Figure 5:
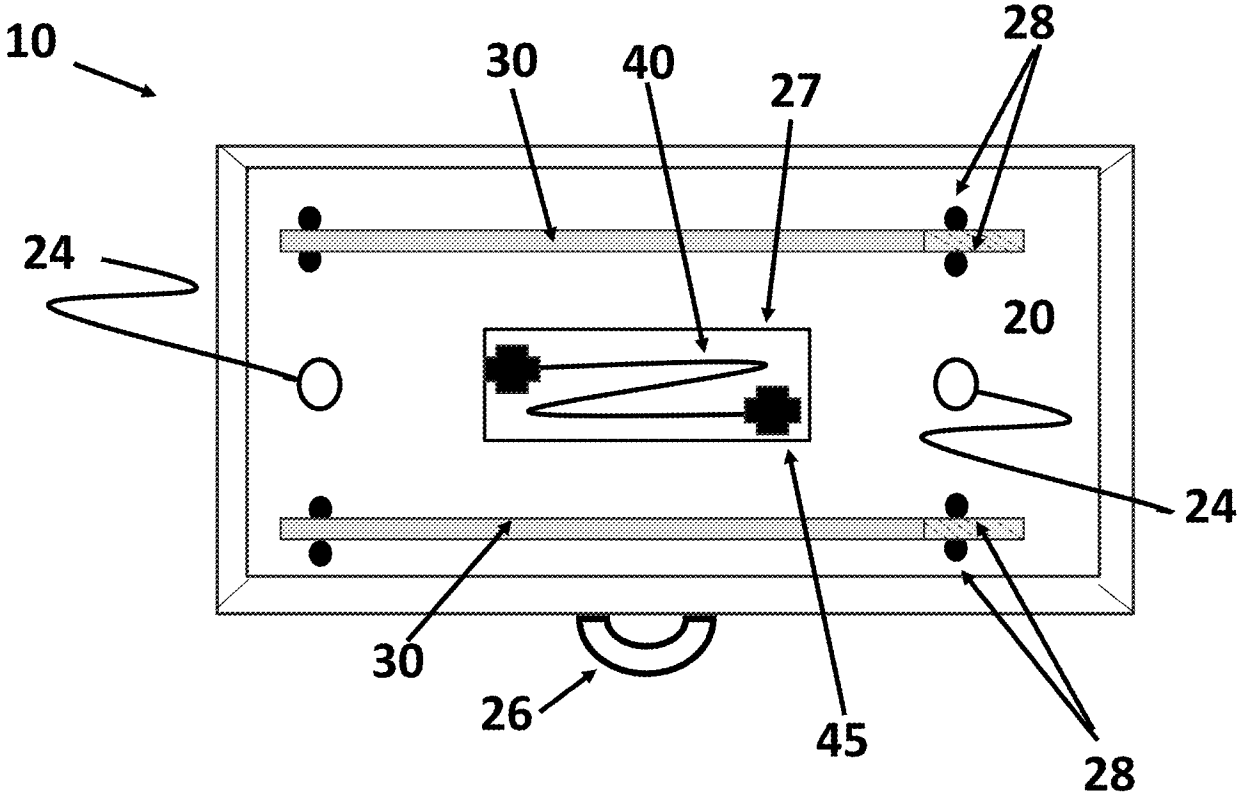
FIG. 5 is a bottom view of the squat height measurement device.

FIG. 5 shows the bottom view of the squat gauge apparatus 10, when the squat depth gauge mechanism 10 is disassembled. Base 20 of the proper squat depth mechanism 10 is configured to hold the components of the apparatus when not in use for easy transportation and storage. Guideposts 30 are positioned in the bottom of the base and held in place by a pair of locking elements 28. The depth indicator 40 and attachment mechanism 45 are housed in a base compartment 27 configured to accommodate the depth indicator 40 and attachment mechanism 45. The base 20 includes the pockets 24 which are configured to accommodate the guideposts when the proper squat depth mechanism 10 is assembled. The base may also be configured to include a handle 26 for the ease of transporting the proper squat depth gauge mechanism 10.

Figure 6:
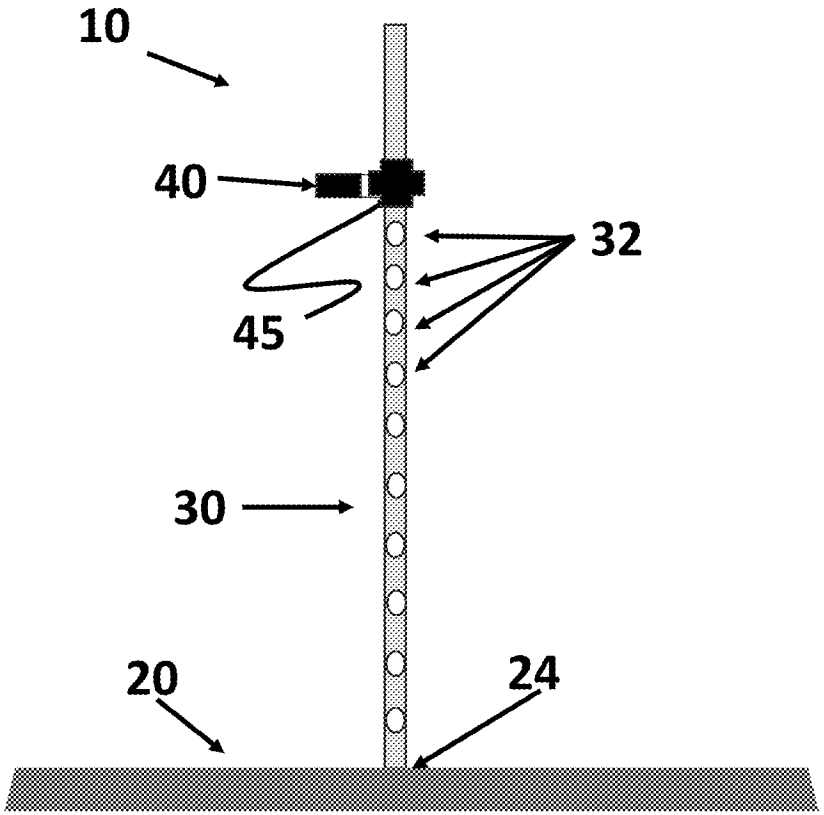
FIG. 6 is a side view of the squat height measurement device.
Figure 7:
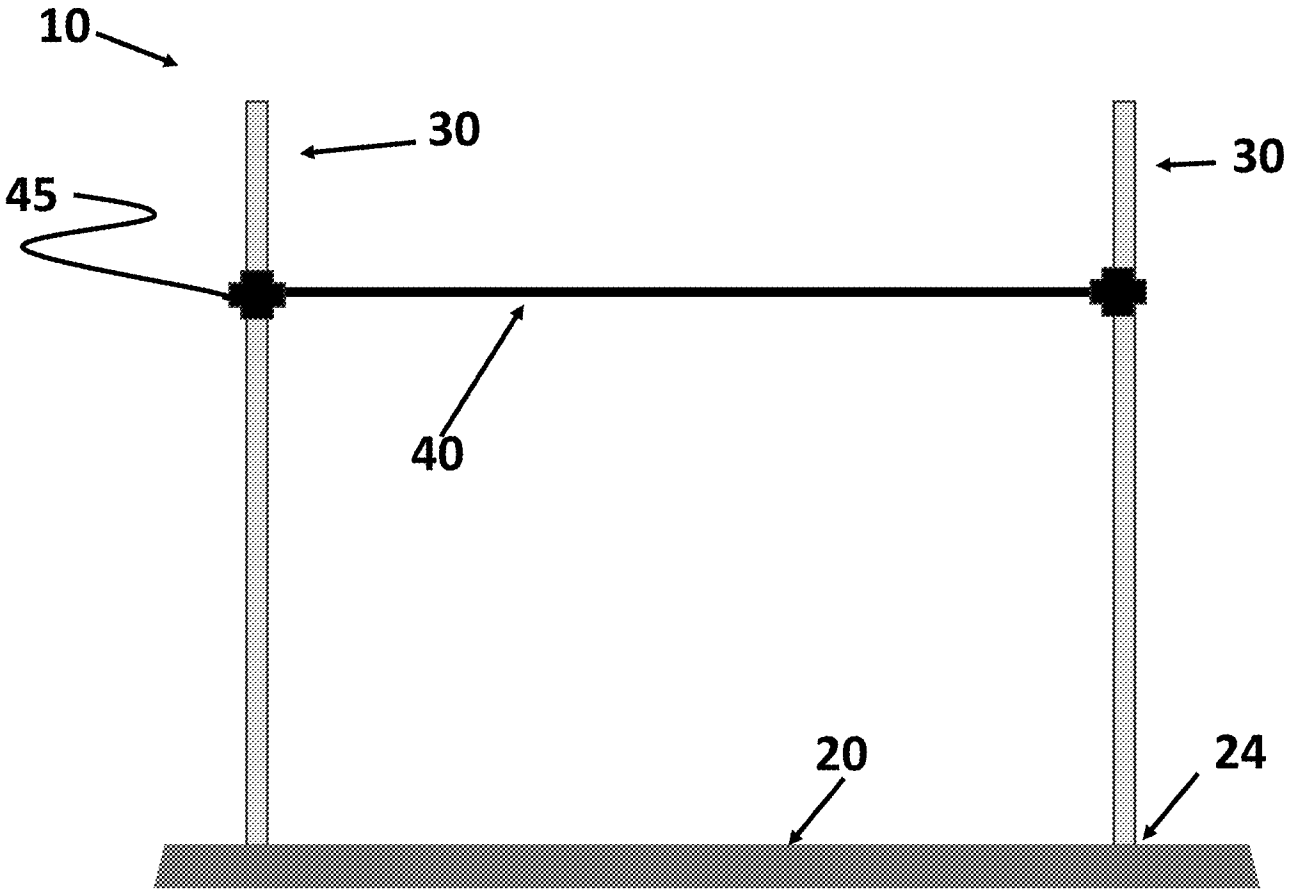
FIG. 7 is a front view of the squat height measurement device.

FIGS. 6 and 7 show the squat depth gauge apparatus 10 having a pair of guideposts 30 affixed to a base 20 at the pockets 24 in the base 20. The guideposts 30 have a plurality of guide indicators 32. The attachment mechanism 45 is configured to engage the guide indicators 32. Affixed to the attachment mechanism 45 is a depth detector 40 which operates to alert the user when he or she has reached a predetermined position of the squat exercise. The detector 40 may be positioned at any position desired. The depth detector 40 contacts the user when the desired depth of the squat exercise is obtained to notify the user that the maximum/proper depth has been obtained and that the user should take action to move toward the extended position.

Figure 8:
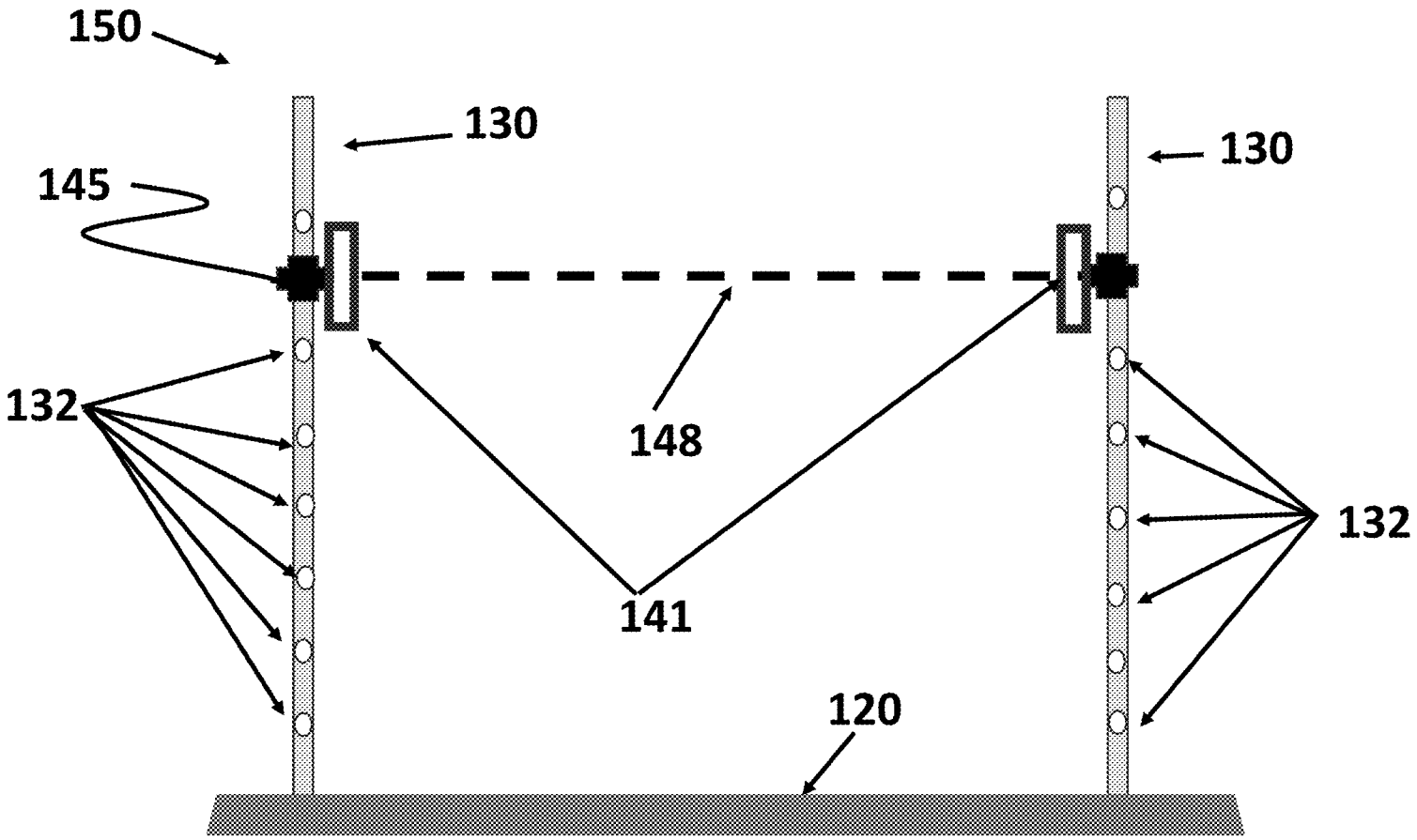
FIG. 8 is a front view of the squat height measurement device depicting an embodiment with an electronic laser measurement device.

An alternative embodiment of the squat depth gauge apparatus 150 is shown in FIG. 8. In this embodiment the squat depth gauge apparatus 150 has a pair of guideposts 130 affixed to a base 120 at the pockets in the base 120. The guideposts 130 have a plurality of guide indicators 132. The attachment mechanism 145 is configured to engage the guide indicators 132. Affixed to the attachment mechanism 145 is a laser depth indicator 141 which operates to alert the user when he or she has reached a predetermined position of the squat exercise. The laser depth indicator 141 can be positioned at any position desired. The laser depth indicator 141 operates to generate a laser signal 148 between the pair of laser depth indicators 141. When the user has reached the desired depth of the squat exercise, the user will break the laser signal 148 generated between the pair of laser depth indicators 141. When the laser signal 148 is broken the laser depth indicator 141 will generate an audio signal (such as an alarm) or visual signal (such as a light projected on a wall) to indicate to the user that the maximum depth has been obtained and that the user should take action to move toward the extended position.

Figure 9:
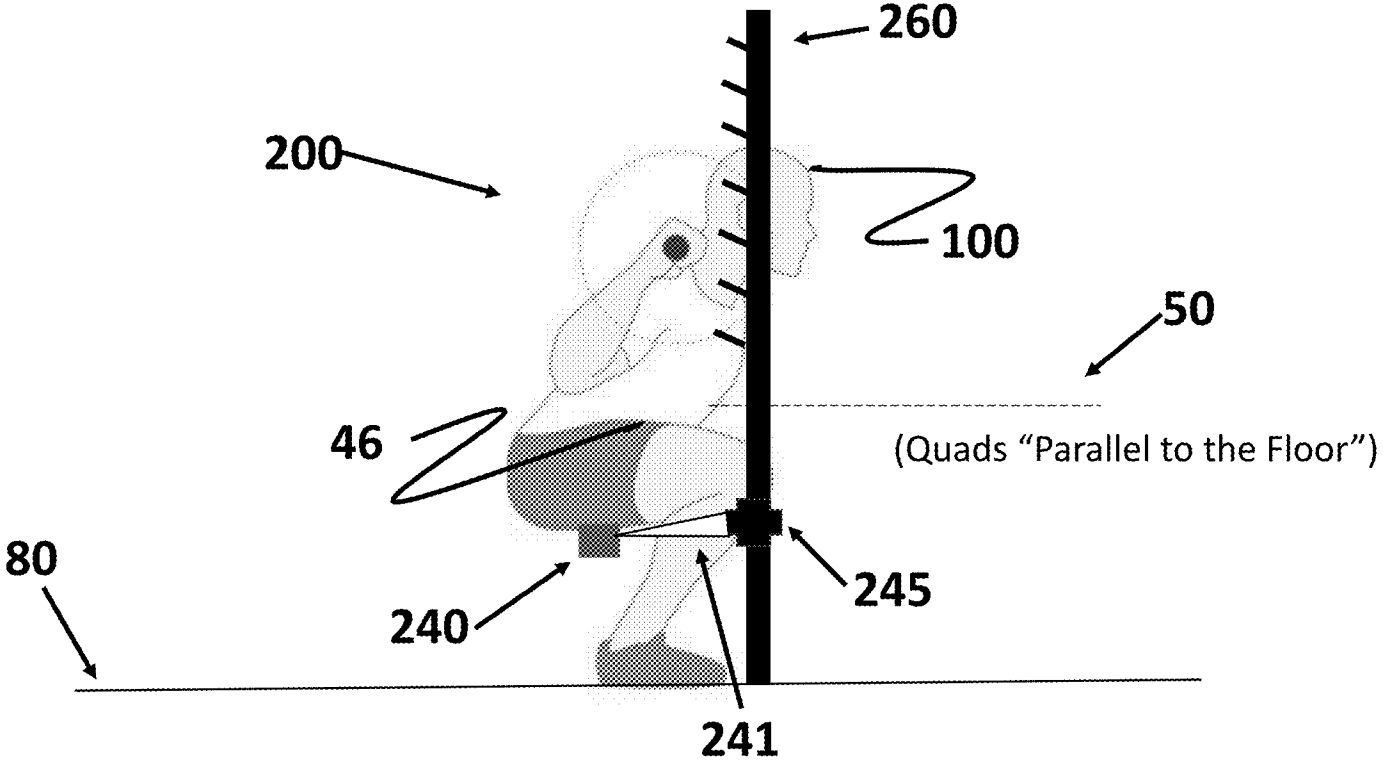
FIG. 9 is a side view of an alternative embodiment of the squat height measurement device where the depth indicator may be attached to a traditional squat rack.

FIG. 9 depicts yet another embodiment of the present invention. In FIG. 9, the squat depth gauge apparatus 200 includes a rack attachment mechanism 245 which is affixed to the squat rack 260 itself, rather than a separate post as described in the prior embodiments. A depth indicator support 241 is attached to the rack attachment mechanism 245. The depth support mechanism is affixed to a depth indicator 240. The depth indicator 240 can be positioned near the squat rack 260 at any position desired by adjusting the rack attachment mechanism to the desired height on the squat rack 260. The depth indicator 240 operates to alert the participant 100 when he or she has reached the reached the desired depth of the squat exercise when the user has contacted the depth indicator 240. In the embodiment of FIG. 9 the depth indicator 240 is a bungee cord like material or a flexible tube of plastic member. When the participant reaches the desired depth of the squat, such as when the top of the quads 46 become parallel to the ground 80, or at a 90-degree angle to the vertical wall 260, the participant is signaled that that the maximum desired depth has been obtained/achieved though making contact with the depth indicator 240 and that the user should take action to move toward the extended position. While the embodiment of FIG. 9 includes a bungee cord like material or a flexible tube of plastic member, it should be appreciated that the laser depth indicator 141 of FIG. 8 could be implemented in place of the physical depth indicator 240. In this embodiment a laser signal 148 between the pair of laser depth indicators 141. When the use has reached the desired depth of the squat exercise, the user will break the laser signal 148 generated between the pair of laser depth indicators 141. When the laser signal 148 is broken the laser depth indicator 141 will generate an audio signal (such as an alarm) or visual signal (such as a light projected on a wall) to indicate to the user that the maximum depth has been obtained and that the user should take action to move toward the extended position.

It should be understood that there are many components to the inventions of the proper squat depth gauge apparatus. While specific combinations of elements are disclosed in specific embodiments, it should be understood that any combination of the different features may be utilized in the squat rack gauge apparatus.

The foregoing disclosure and description of the invention are illustrating and explanatory thereof, and various changes in the size, shape and materials as well as in the details of illustrated construction may be changed without departing from the spirit of the invention.

It is understood that the invention is not limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A squat depth gauge apparatus for use in connection with a squat exercise comprising:

a base configured to be positioned in proximity to a user such that a user can conduct a squat exercise, wherein the base includes a first pocket and a second pocket;

a first guidepost and a second guidepost, the first guidepost removably affixed to the first pocket of the base and the second guidepost removably affixed to the second pocket of the base;

the first guidepost configured to include a plurality of first guide gauge indicators and second guidepost is configured to include a plurality of second guide gauge indicators such that the plurality of the guide gauge indicators on the first guidepost correspond to the plurality of guide gauge indicators on the second guidepost;

a first attachment mechanism configured to engage one of the plurality of the first guide gauge indicators on the first post at a position the user selects to be a maximum squat depth;

a second attachment mechanism configured to interact with at least one of the plurality of guide gage indicators positioned on the second guidepost attachment mechanism wherein the first guidepost attachment mechanism is parallel to the second guidepost attachment mechanism; and a depth indicator affixed to the first guidepost attachment mechanism and the second guidepost attachment mechanism wherein the depth indicator operates to contact the user when the user has reached the maximum selected squat depth for the squat exercise to notify the user that the user has reached the maximum desired depth of the squat exercise.

2. The squat depth gauge apparatus for use in connection with a squat exercise of claim 1, wherein the base has a rectangular configuration.

3. The squat depth apparatus for use in connection with a squat exercise of claim 1, wherein the plurality of first guide gauge indicators comprise slots in the first guidepost and the plurality of second guide gauge indicators comprise slots in the second guidepost.

4. The squat depth gauge apparatus for use in connection with a squat exercise of claim 1, wherein the first guide gauge indicators are height markings on the first guidepost and second guide gauge indicators are height markings on the second guidepost.

5. The squat depth gauge apparatus for use in connection with a squat exercise of claim 1, wherein the depth indicator is made of flexible material.

6. The squat depth gauge apparatus for use in connection with a squat exercise of claim 5, wherein the depth indicator is an adjustable bungee cord.

7. The squat depth gauge apparatus for use in connection with a squat exercise of claim 1, wherein the depth indicator is a rigid material.

8. The squat depth gauge apparatus for use in connection with a squat exercise of claim 3, wherein the first attachment mechanism comprises a hook configured to engage one of the plurality of the first guide gauge indicators and the second attachment mechanism comprises a hook configured to engage one of the plurality of the second guide gauge indicators.

9. The squat depth gauge apparatus for use in connection with a squat exercise of claim 1, wherein the first attachment mechanism and second attachment mechanism comprise a clamp.

10. The squat depth gauge apparatus for use in connection with a squat exercise of claim 1, further comprising a base storage configured within the base, the base storage comprising a first guidepost storage positioned in the base storage;

a second guidepost storage positioned in the base storage; and a depth indicator storage positioned in the base storage.

11. The squat depth gauge apparatus of claim 10, further comprising a handle affixed to the base.

12. The squat depth gauge apparatus of claim 1, wherein the first pocket includes threads, and the first guidepost is threadedly engaged with the first pocket, and the second pocket includes threads, and the second guidepost is threadedly engaged with the second pocket.

13. The squat depth gauge apparatus of claim 1, further comprising a plurality of predetermined measurement indicators positioned on one of the first guidepost or second guidepost wherein the measurement indicators can be used to identify the optimal height of the maximum selected depth such that the optimal height of the maximum selected squat depth is when the users quads are at a position that is parallel to the floor during a squat exercise.

14. The squat depth gauge apparatus for use in connection with a squat rack comprising:

a squat rack including plurality of the guide gauge indicators positioned on the squat rack;

a first attachment mechanism configured to engage the squat rack at one of the plurality of the guide gauge indicators at a position the user selects to be a maximum squat depth;

a second attachment mechanism configured to engage the squat rack wherein the first guidepost attachment mechanism is parallel to the second guidepost attachment mechanism;

a first depth indicator support affixed to the first attachment mechanism;

a second depth indicator support affixed to the second attachment mechanism; and a depth indicator affixed to the first depth indicator support and the second depth indicator support wherein the depth indicator operates to contact the user when the user has reached the maximum selected squat depth for the squat exercise to notify the user that the user has reached the maximum desired depth of the squat exercise.

15. The squat depth gauge apparatus for use in connection with a squat rack of claim 14, wherein, the depth indicator is made from a flexible plastic material.

16. The squat depth gauge apparatus for use in connection with a squat rack of claim 14, wherein, the depth indicator is a flexible bungee cord.

17. The squat depth gauge apparatus for use in connection with a squat exercise comprising:

a base configured to be positioned in proximity to the squat rack such that a user can conduct a squat exercise, wherein the base includes a foot support portion for the user to place the user's feet during the squat exercise, the base includes a first pocket and a second pocket;

a first guidepost and a second guidepost, the first guidepost removably affixed to the first pocket of the base and the second guidepost removably affixed to the second pocket of the base;

the first guidepost configured to include a plurality of first guide gauge indicators and second guidepost is configured to include a plurality of second guide gauge indicators such that the plurality of the guide gage indicators on the first guidepost correspond to the plurality of guide gage indicators on the second guidepost;

a first attachment mechanism configured to engage one of the plurality of the first guide gauge indicators on the first post at a position the user selects to be a maximum squat depth;

a second attachment mechanism configured to interact with at least one of the plurality of guide gage indicators positioned on the second guidepost attachment mechanism wherein the first guidepost attachment mechanism is parallel to the second guidepost attachment mechanism;

a first laser depth indicator configured to be attached to the first attachment mechanism and a second laser depth indicator configured to be attached to the second attachment mechanism;

a laser signal generated between the first laser depth indicator and a second laser depth indicator, wherein the laser signal is interrupted when a user contacts the user when the user has reached the maximum selected squat depth for the squat exercise to notify the user that the user has reached the maximum desired depth of the squat exercise; and a signal generated by the first laser depth indicator when the user has reached the maximum selected squat depth for the squat exercise to notify the user that the user has reached the maximum desired depth of the squat exercise.

18. The squat depth gauge apparatus for use in connection with a squat exercise of claim 17, wherein the signal is an audio signal.

19. The squat depth gauge apparatus for use in connection with a squat rack of claim 17, wherein the signal is a visual signal.

20. The squat depth gauge apparatus for use in connection with a squat rack of claim 17, wherein the signal is both an audio signal and a visual signal.

* * * * *